US012790940B1

(12) United States Patent
Alqahtani et al.

(10) Patent No.: US 12,790,940 B1
(45) Date of Patent: Nov. 10, 2026

(54) ACTIVE MULTI-SHELL WATER CUT SENSOR

(71) Applicant: SAUDI ARABIAN OIL COMPANY, Dhahran (SA)

(72) Inventors: Bader Alqahtani, Dammam (SA); Pranay Asthana, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/221,712

(22) Filed: May 29, 2025

(51) Int. Cl.
*E21B 47/11* (2012.01)

(52) U.S. Cl.
CPC ..... *E21B 47/11* (2020.05)

(58) Field of Classification Search
None
See application file for complete search history.

(56) References Cited

U.S. PATENT DOCUMENTS

| | | | |
|---|---|---|---|
| 5,892,147 | A | 4/1999 | Garnes et al. |
| 8,877,506 | B2 | 11/2014 | Roberts et al. |
| 8,949,029 | B2 | 2/2015 | Nyhavn |
| 9,290,689 | B2 | 3/2016 | Lafitte et al. |
| 9,416,651 | B2 | 8/2016 | Al-Rabeh |
| 10,370,587 | B2 | 8/2019 | Borrell et al. |
| 10,760,411 | B2 | 9/2020 | Robey et al. |
| 10,927,292 | B2 | 2/2021 | Borrell et al. |
| 10,961,443 | B2 | 3/2021 | Zhao |
| 11,084,966 | B2 | 8/2021 | Burns et al. |
| 11,788,377 | B2 | 10/2023 | Al Sulaiman et al. |
| 12,000,278 | B2 | 6/2024 | Chen et al. |
| 12,012,848 | B2 | 6/2024 | Sperle et al. |
| 12,018,561 | B2 | 6/2024 | Sperle et al. |
| 2007/0241277 | A1 | 10/2007 | Stray et al. |
| 2010/0132944 | A1 | 6/2010 | Li et al. |
| 2011/0257887 | A1 | 10/2011 | Cooper et al. |
| 2013/0017610 | A1 | 1/2013 | Roberts et al. |
| 2015/0060059 | A1* | 3/2015 | Langlais ..... E21B 43/08 166/227 |
| 2017/0166798 | A1* | 6/2017 | Okamoto ..... E21B 33/14 |
| 2022/0228478 | A1 | 7/2022 | Sperle et al. |
| 2023/0003110 | A1* | 1/2023 | Ellis ..... E21B 47/11 |
| 2024/0247581 | A1* | 7/2024 | Abe ..... E21B 33/1208 |

OTHER PUBLICATIONS

International Search Report and Written Opinion issued in Application No. PCT/US2025/043883, mailed on Feb. 17, 2026 (15 pages).

* cited by examiner

*Primary Examiner* — Andrew Sue-Ako
(74) *Attorney, Agent, or Firm* — Osha Bergman Watanabe & Burton LLP

(57) ABSTRACT

A tracer encapsulation system includes a housing and a tracer bead. The housing includes a flowpath fluidly connecting an inlet of the housing to an outlet of the housing and a permeable barrier extending across the flowpath. The permeable barrier divides the flowpath into a first section and a second section, where the tracer bead is disposed inside the first section of the housing. The tracer bead has multiple dissolvable layers concentrically surrounding an inert core. Each dissolvable layer comprises a layer material having a different solubility in water. The multiple dissolvable layers are relatively positioned such that the solubility of each dissolvable layer decreases in a direction toward the inert core. The tracer bead has a diameter larger than pores in the permeable barrier, so that the tracer bead does not pass through the permeable barrier.

13 Claims, 9 Drawing Sheets

ACTIVE MULTI-SHELL WATER CUT SENSOR

BACKGROUND

In oil and gas reservoirs, operations may be performed in a well at various depths below the surface with downhole tools. For example, fluids are typically produced from a reservoir in a formation by drilling a wellbore into the formation, establishing a flow path between the reservoir and the wellbore, and conveying the fluids from the reservoir to the surface through the wellbore. Typically, a production tubing is disposed in the wellbore to carry the fluids to the surface. The produced fluids may include hydrocarbons (e.g., oil and/or gas) and/or water.

During production, a ratio of hydrocarbons (e.g., oil and/or gas) to water may vary throughout the lifetime and different production zones of the well. Therefore, it is advantageous to measure water cut of production zones in the well. Water cut may refer to the percentage of water in the total volume of liquids produced by the well over a given production time. For example, if a well produces 1,000 barrels of fluid in a day, of which 500 barrels is water, the water cut is 50%. Tracers coupled with logging methods may be used to measure reservoir properties, such as porosity, permeability, and flowrate in order to measure water cut of the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to tracer encapsulation systems including a housing and a tracer bead. The housing includes a flowpath fluidly connecting an inlet of the housing to an outlet of the housing and a permeable barrier extending across the flowpath. The permeable barrier may divide the flowpath into a first section and a second section, where the tracer bead may be disposed inside the first section of the housing. Tracer beads may include multiple dissolvable layers concentrically surrounding an inert core. Each dissolvable layer comprises a layer material having a different solubility in water. The multiple dissolvable layers may be relatively positioned such that the solubility of each dissolvable layer decreases in a direction toward the inert core. The tracer bead has a diameter larger than pores in the permeable barrier, so that the tracer bead does not pass through the permeable barrier.

In another aspect, embodiments disclosed herein relate to methods for tracking water content from a well. The methods may include installing a tracer encapsulation system in a downhole location in the well, wherein the tracer encapsulation system includes a housing having a flowpath therethrough. The flowpath may be divided into a first section and a second section by a permeable barrier. The methods may further include providing a tracer bead inside the first section and flowing fluid through the flowpath to contact the tracer bead. Tracer beads may include multiple dissolvable layers concentrically surrounding an inert core, wherein each dissolvable layer includes a layer material having a different solubility. Tracer beads may have a diameter larger than pores of the permeable barrier, so that the tracer bead does not pass through the permeable barrier. Methods may further include contacting the fluid with a first dissolvable layer of the dissolvable layers to dissolve the first dissolvable layer and release a first dissolved layer material into the fluid, wherein the first dissolved layer material includes a first tracer compound. The first tracer compound is associated with the solubility of the first dissolvable layer. Methods may further include releasing the first tracer compound through the permeable barrier with the fluid flowing through the housing, identifying the released first tracer compound using spectrometry, and using an association between the released and identified first tracer compound and the solubility of the first dissolvable layer, measuring a first water content of the fluid.

Other aspects and advantages of the claimed subject matter will be apparent from the following description and the appended claims.

DETAILED DESCRIPTION

Figure 1:
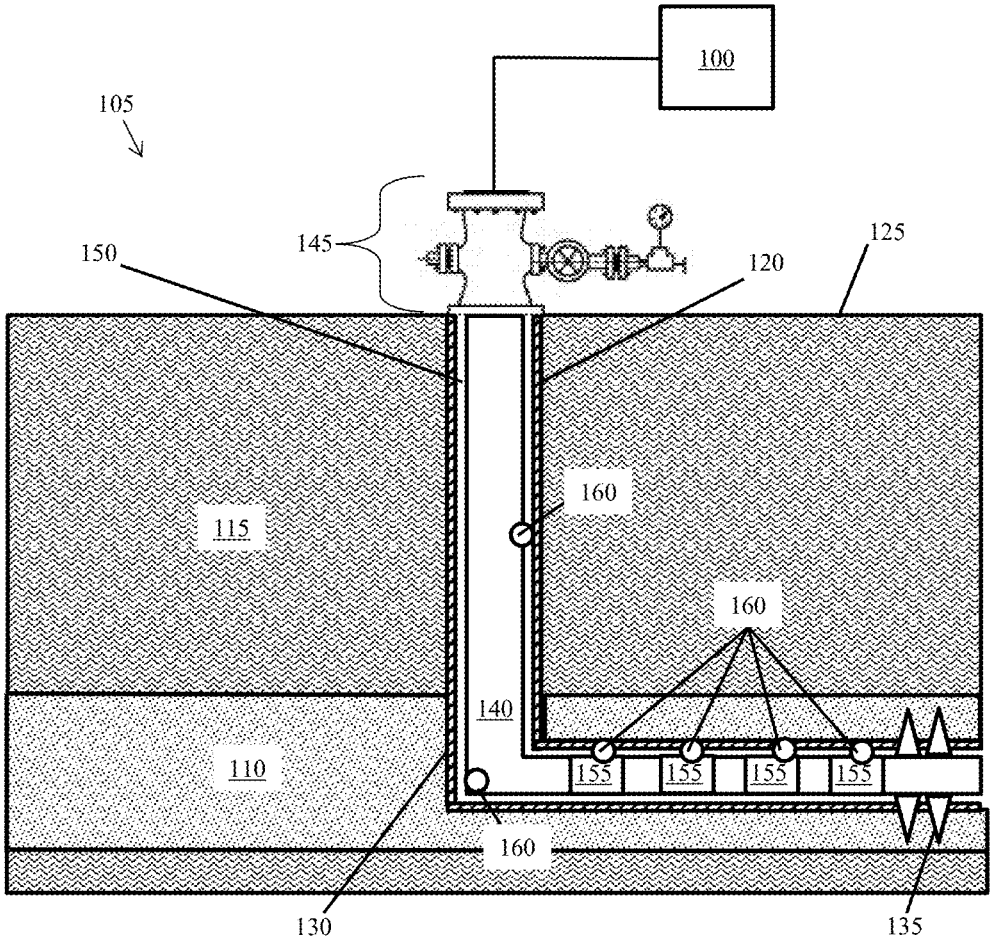
FIG. 1 shows a well system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure describe a tracer encapsulation system and method for characterizing oil and gas reservoirs. For example, the tracer encapsulation system may utilize a dissolvable multi-shell composite ball system filled with tracers to measure varying water cuts of each production zone in a well. The tracer encapsulation system may include tracer beads having an inert ball at the core and concentric dissolvable layers around the core. Each dissolvable layer may be designed to dissolved at specific water cut ranges in an oil and water mixture. Unique tracer compounds may be dispersed within each dissolvable layer and may be gradually released as outer layers dissolve. As a result, a type of tracer released may be associated to a defined range of water cut.

Advantages of the embodiments disclosed herein include precise monitoring of water influx by identifying the type of tracer released. Water influx may refer to movement or flow of water from surrounding zones in the reservoir. Further advantages include flexible placement of the tracer encapsulation system at any point along a fluid flow path in the well. The tracer encapsulation system may detect breakthrough of water and quantifies water cut when ingress continues through the life of the well. Additionally, the tracer encapsulation system may be used to determine which production zone is producing water. Accordingly, tracer encapsulation systems according to embodiments of the present disclosure may reduce intervention operational costs, serve as a production logging tool, and validate rate tests conducted at surface. Validation of rate test results may provide a layer of confidence in results.

FIG. 1 shows a production operation with a management system (100) at a well site (105) in accordance with one or more embodiments. Well fluids are produced from a reservoir (110) in a formation (115) by drilling a wellbore (120) into the formation (115) and establishing a flow path between the reservoir (110) and the wellbore (120). Well fluids are conveyed from the reservoir (110) to a surface (125) through the wellbore (120).

The wellbore (120) may include a vertical section to reach the reservoir (110). A casing (130) may be installed in the wellbore (120), e.g., by lowering the casing into an open hole section of the well and cementing in place to line the well. Casing may be formed of threaded together sections of pipe (sometimes referred to as casing joints), often made of carbon steel. In some embodiments, the casing (130) may be perforated (e.g., using perforating guns) to provide fluid communication between the formation and the interior of the well via perforations (135) extending into the reservoir (110), thereby allowing a flow of well fluids to enter the wellbore (120). In some embodiments, fluid communication between the formation and well may be provided by open hole completion (where no casing is cemented in the target section of the well). In some embodiments, fluid communication between the formation and well may be provided by slotted or pre-perforated liners, where a section of pipe may have pre-cut slots or holes that allow a flow of well fluids to enter the well. In some embodiments, fluid communication between the formation and well may be provided by a screen (e.g., sand screen) and/or a gravel pack positioned in an open hole section of the well to allow a filtered flow of fluids to enter the well. A production tubing string (140) is disposed in the wellbore (120) to carry the well fluids to the surface (125). The production tubing string (140) hangs from a wellhead (145) at the surface (125) and forms an annulus (150) between the production tubing string (140) and the wellbore (120). The production tubing string (140) may extend horizontally into the reservoir (110), thereby forming a flow conduit from the reservoir (110) to the surface (125).

From the wellhead (145), the fluids from the well are transported, via a production flow line, to a production storage, transport, or facility. In some embodiments, a Christmas tree may be disposed on top of the wellhead (145) for fluid transportation. In some embodiments, the production tubing string (140) may be an injection tubing string that injects fluid down into the reservoir (110). For example, a fluid source may be coupled to the wellhead (145) and fluids from the fluid source may be injected through the wellhead (145) down the injection tubing string and into the reservoir (110).

As well fluids are produced from the reservoir (110), the well fluids flow into the annulus (150). The reservoir (110) may include one or more production zones. As is well known in the art, production zones are specific geological formations within a well where the well fluids are extracted. A person of ordinary skill in the art would appreciate that production zones of the reservoir (110) may be identified, including identifying production zone location and type of fluid production, for optimizing well design, production strategies, and maximizing recovery. A production zone may produce different types and amounts of well fluid, including hydrocarbon fluids (e.g., oil and/or gas) and water. Further, the type(s) and amounts of well fluid (e.g., the ratio of hydrocarbons to water) produced from a production zone may vary throughout the lifetime of the well. For example, the amount of water in the well fluids produced from a production zone (also referred to as the water cut from the production zone) may vary over the lifetime of the well.

In one or more embodiments, inflow control devices (155) may be provided along the well (e.g., installed on the production tubing string (140), installed on sand screens or gravel pack assemblies, and/or installed along other downhole equipment) to control fluid flow from the surrounding formation into the well. Various types of inflow control devices (ICDs) may be used, such as nozzle-based ICDs (where nozzles restrict the fluid flow), valved ICDs (where a valve restricts the fluid flow, e.g., an electrically, hydraulically, and/or automatically controlled valve), and/or channel-based ICDs (where a tortuous flow path therethrough may manipulate the fluid flow). While different inflow control assemblies may be colloquially referred to by different names according to their function or distinguishing parts, the term inflow control device (ICD) is used herein as an umbrella term that encompasses the different types of inflow control assemblies, including passive ICDs, autonomous ICDs, and active (valved) devices that are sometimes referred to in the industry as inflow control valves (ICVs). ICDs may be positioned along a well in locations corresponding to one or more production zones. In some embodiments, one or more ICDs may be isolated within an associated production zone, e.g., where the ICD(s) may be positioned between a pair of packers that isolate the associated production zone, such that well fluid from the associated production zone flows only through the ICD(s) to the surface of the well. In one or more embodiments, ICDs may be operated to control the flow of well fluids from one or more production zones into the production tubing string (140), to be carried to the surface. For example, one or more inflow control devices (155) may be provided along the production tubing string (140) and operated to control an influx of water well fluid flowing from the surrounding formation. As the well fluids flow in the annulus (150), the produced well fluids may flow from the annulus (150) and into the production tubing string (140) via the one or more inflow control device (155).

In one or more embodiments, tracer encapsulation systems (160) are provided on the well equipment throughout the well site (105). For example, tracer encapsulation systems (160) may be provided on the production tubing string (140) to measure various pressures, temperatures, flow rates, and fluid properties of a fluid in a downhole environment within the production tubing string (140) and/or in the annulus (150).

In one or more embodiments, tracer encapsulation systems (160) may be provided on the one or more inflow control devices (155) to measure reservoir properties, such as water cuts, porosity, permeability, and flowrate, of a fluid exiting the reservoir (110) and entering the production tubing string (140). In some embodiments, the tracer encapsulation systems (160) may include sensors for measuring various pressures, temperatures, flow rates, and fluid properties of a fluid.

Furthermore, tracer encapsulation systems (160) provided on the production tubing string (140) proximate perforations (135) or other fluid communication access points along the well may measure water cuts of well fluids from the reservoir (110). Although the tracer encapsulation systems (160) are shown specifically positioned throughout the completion well site (105) and in or around flow control equipment, such as inflow control devices, a person of ordinary skill in the art would appreciate that the position of tracer encapsulation systems (160) is not limited to those shown and may be placed in any downhole location in any well.

Figure 2:
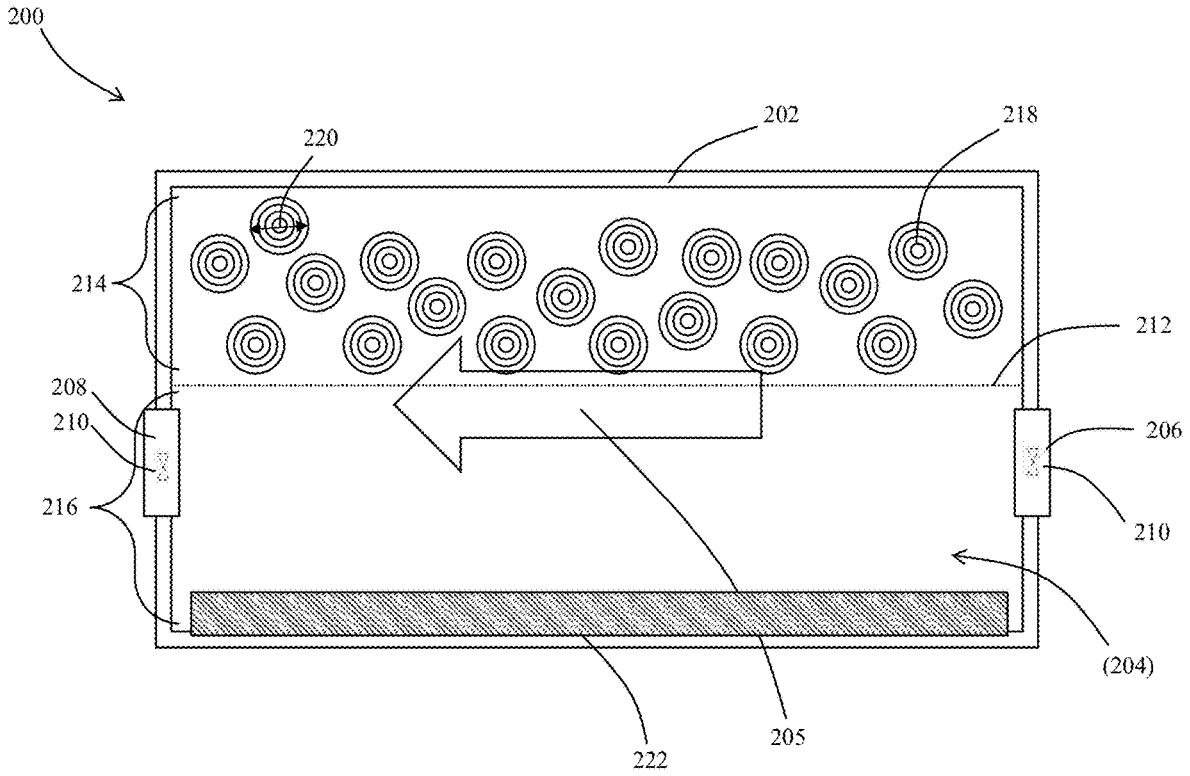
FIG. 2 shows a tracer encapsulation system in accordance with one or more embodiments.

FIG. 2 shows a tracer encapsulation system (200) in accordance with one or more embodiments. The tracer encapsulation system (200) described in FIG. 2 may be implemented as the tracer encapsulation system (160) described in FIG. 1. The tracer encapsulation system (200) includes a housing (202). A flowpath (204) is formed through the interior of the housing (202), fluidly connecting an inlet (206) of the housing to an outlet (208) of the housing, such that incoming fluid flow (205) from the housing inlet (206) may flow along the flowpath (204) through the interior of the housing (202) to the housing outlet (208). The flowpath (204) may be any path for fluid to flow from the inlet (206) to the outlet (208), such as well fluid. In some embodiments, the inlet (206) and/or the outlet (208) may have a valve (210) to control the fluid flow (205) into/out of the housing (202).

According to embodiments of the present disclosure, a permeable barrier may extend across the flowpath to divide the flowpath into two sections. In FIG. 2, the cross-sectional view shows the permeable barrier (212) extending axially along the flowpath (204), where the permeable barrier (212) transverses the flowpath (204) in the radial direction to divide the flowpath (204) into a first section (214) and a second section (216). When the tracer encapsulation system 200 is deployed in a well, the first section (214) may be oriented in a gravitationally upper position relative to the second section (216). In some embodiments, the permeable barrier (212) is made up of an inert material. For example, the permeable barrier (212) may be made up of any type of material that can survive downhole conditions and is inert to the surroundings of the permeable barrier (212), such as steel (e.g., a perforated steel sheet) including high strength alloys and nonmetallic materials including polyetheretherketone (PEEK). One or more tracer beads (218) may be placed in the fluid flowpath (204), such that the tracer bead(s) (218) are held inside the housing (202) within the first section (214) of the flowpath (204) by the permeable barrier (212).

The permeable barrier (212) allows fluid to flow through the flowpath (204), but prevents the tracer beads (218) from passing through. The tracer bead(s) (218) have diameter(s) (220) larger in size than pores (i.e., pore (714), shown in FIG. 6) in the permeable barrier (212). For example, when fluid enters the inlet (206) and flows through the flowpath (204), the fluid flow (205) is carried through the permeable barrier (212) encountering the tracer beads (218), and may then exit the outlet (208). In one or more embodiments, valve(s) (210) at the inlet (206) and/or outlet (208) may be operated to control the rate of fluid flow (205) through the flowpath (204) (e.g., including the amount of fluid and duration in which the fluid is held in the housing). For example, an amount of fluid may be directed through the flowpath (204) and held therein for a duration sufficient for the fluid to contact the tracer bead(s) (218) within the first section (214). The permeable barrier (212) aides in keeping the tracer beads (218) inside the first section (214) to prevent the tracer beads (218) from entering the second section (216).

A counterweight (222) or counterweight mechanism may be provided along a side of the housing (202) opposite from the first section (214). To provide a correct orientation of the tracer encapsulation system (200) during installation and completion, the counterweight (222) allows the housing (202) to self-orient based on direction of gravity. The counterweight (222) may be any device or mechanism capable of correcting orientation of the housing (202), so that the first section (214) remains in a gravitationally upper position relative to the second section (216). The counterweight (222) may be made up of materials, such as lead, tungsten, steel, and/or aluminum.

The tracer beads (218) may have a dissolvability feature useful for water cut detection. For example, tracer beads (218) may include one or more dissolvable layers, where each dissolvable layer is designed to dissolve in a fluid having a selected water cut range. Unique tracer compounds may be provided in each dissolvable layer, such that the tracer compound in each dissolvable layer may be associated with the water cut range that dissolves the dissolvable layer. As fluid passes through the housing (202) along the flowpath (204), dissolvable layer(s) containing tracer compounds of the tracer beads (218) dissolve based on water cut present in the passing fluid. The water cut range of the passing fluid flow may then be identified by identifying the released tracer compounds and their associated water cut range (i.e., the water cut range that dissolves the dissolvable layer in which the associated tracer compounds were initially provided).

Figure 3:
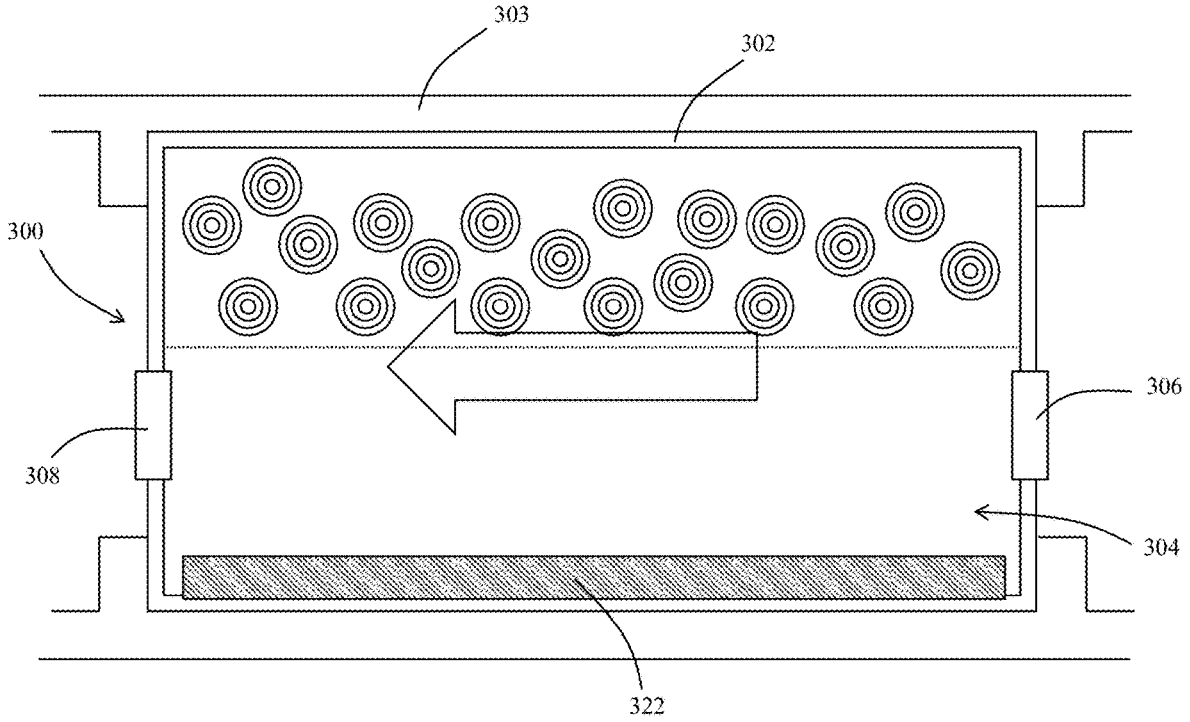
FIG. 3 shows a tracer encapsulation system in accordance with one or more embodiments.

FIG. 3 shows another example of a tracer encapsulation system according to embodiments of the present disclosure. Specifically, the tracer encapsulation system (300) of FIG. 3 includes a housing (302) rotatably mounted to a stator structure (303) (e.g., which may be part of production tubing string (140)). The housing (302) may have a cylindrical profile rotatably mounted in an annularly shaped body of the stator structure (303). While the example shown in FIG. 3 includes the housing (302) rotatably mounted interior to the stator structure (303), other configurations may have an interiorly positioned stator structure, where a tracer encapsulation system housing may be rotatably mounted to and extend annularly around an outer surface of the stator structure. A person of ordinary skill in the art would appreciate that the housing (302) may be rotatably mounted on any stator structure (303) based on usage of other connection configurations.

Further, in FIG. 3, a counterweight (322) may be provided along a weighted side of the housing (302) intended to be oriented in a gravitationally lowermost position relative the remainder of the housing (302). The housing (302) may be mounted to the stator structure (303) in a configuration that allows the weighted side of the housing to freely rotate to the gravitationally lowermost position (e.g., by using a bearing interface between the interfacing housing and stator structure surfaces).

Similar to FIG. 2, the housing (302) includes a flowpath (304) fluidly connecting an inlet (306) to an outlet (308). For example, fluid may flow along the flowpath (304) through an interior of the housing (302). The flowpath (304) may be any path for fluid to flow from the inlet (306) to the outlet (308), such as production or reservoir fluid.

A person of ordinary skill in the art may appreciate that the configuration of the tracer encapsulation system is not limited to the specified configurations shown in the figures. For example, other configurations may be implemented for different types of wells, such as deviated wells, and at different points of the wells to create an annular flow path for fluid before it enters the tubing, while maintaining a gravitational orientation in the instance of flow stops and oil/water separation. In other embodiments, the tracer encapsulation system may be implemented in a vertical well.

Figure 4:
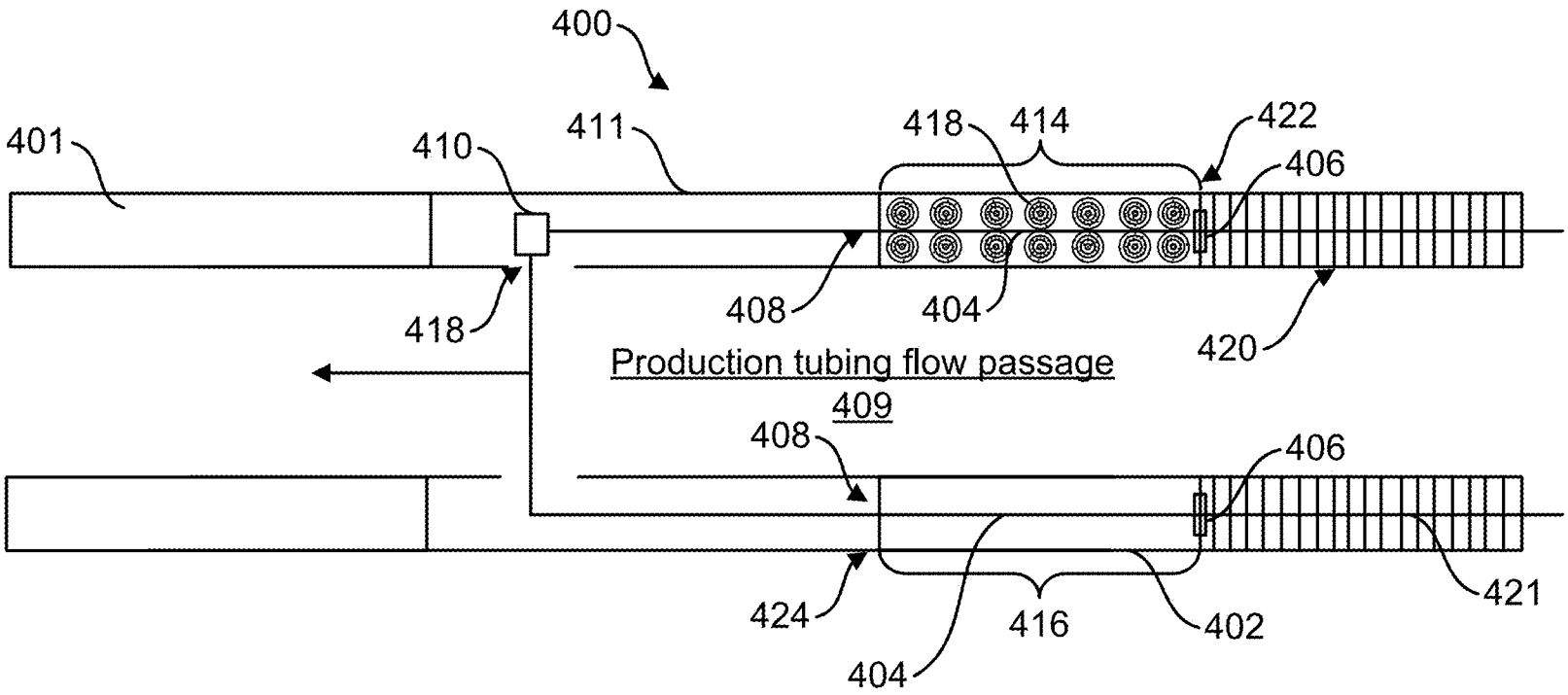
FIG. 4 shows a tracer encapsulation system in accordance with one or more embodiments.

FIG. 4 shows another example of a tracer encapsulation system (400) in accordance with one or more embodiments. Specifically, FIG. 4 shows a tracer encapsulation system (400) implemented as part of a production tubing string (e.g., production tubing (140)). For example, a production tubing string may include a plurality of generally tubular-shaped members, including production tubing pipe segments and/or joints (collectively referred to as production tubing (401)) and downhole completion tools (sometimes also referred to as tubing-deployed equipment or tubular accessories) such as ICDs, sand screens, sliding sleeves, and annular packers, which may be threaded together or otherwise connected together in an axial end-to-end manner. In one or more embodiments, the tracer encapsulation system (400) may be integrally provided with a downhole completion tool, such as an ICD, which may be connected to a production tubing (401) in an axial end-to-end manner. Further, tracer encapsulation systems according to embodiments disclosed herein, such as in FIG. 4, may be provided in a generally tubular configuration (e.g., having an annular-shaped housing), where a tracer encapsulation system may be assembled coaxially with the other tubular-shaped members forming the production tubing string. In other embodiments, the tracer encapsulation system (400) may be inserted in the production tubing (401). For example, the geometry of the tracer encapsulation system (400) may be altered to fit inside the production tubing (400) and monitor fluid composition of any flow upstream to the location of the tracer encapsulation system (400).

The tracer encapsulation system (400) described in FIG. 4 may be implemented as the tracer encapsulation system (160) described in FIG. 1. The tracer encapsulation system (400) includes a housing (402). The housing (402) may be an annular housing assembly rotatably mounted to a production tubing (401) of the production tubing string. Although the production tubing (401) may rotate during installation of the production tubing string into a well, the production tubing (401) may act as a stator structure because the housing (402) may rotate relative to the production tubing (401). A fluid flowpath (404) flows through the housing (402) of the tracer encapsulation system (400) from an inlet (406) to an outlet (408). The flowpath (404) may have an annular shape. Depending on desired pressure differential and velocity of fluid passing through the tracer encapsulation system (400), the inlet (406) and outlet (408) may open annularly around the entire circular end of the housing (402) or one or more smaller or discrete openings may span around the circular geometry of the housing (402) that fluidly connect to the annular fluid flowpath (404). For example, an inlet may be formed of one or more discrete openings positioned around an inlet end of the housing, and an outlet may be formed of the same or a different amount of discrete openings positioned around an outlet end of the housing, opposite the inlet end. The outlet (408) may be fluidly connected to a production tubing flow passage (409) extending through an interior of the production tubing string. As shown, the housing flowpath (404) may extend axially through the housing (402), generally parallel with the production tubing flow passage (409).

In some embodiments, the tracer encapsulation system (400) may be provided as part of an ICD (411), where the outlet (408) of the tracer encapsulation system housing (402) is fluidly connected to an ICD outlet (418) (e.g., which may include a nozzle), and where the ICD outlet (418) provides the fluid connection to the production tubing flow passage (409). For example, the housing (402) of the tracer encapsulation system (400) may be integrally provided with the ICD (411). In some embodiments, an ICD valve (410) may be provided at the ICD outlet (418) to control the fluid communication from the outlet (408) to the production tubing flow passage (409) of the production tubing string.

Further, as shown in FIG. 4, the tracer encapsulation system (400) may include a screen (420) connected to a first end (422) of the housing (402), where the outlet (408) is disposed at a second end (424) of the housing (402), opposite the first end (422), and the first section (414) and second section (416) are disposed in between the first and second ends. The screen (420) may have a tubular-shaped body, where an axial end of the screen (420) may be connected to the first end (422) of the housing (402) such that the screen (420) is coaxial with the housing (402). In one or more embodiments, a screen may be connected to a tracer encapsulation system housing in an axial end-to-end fashion, e.g., using a threaded connection, latches, pins, locking mechanisms, and/or other tubing string connection mechanisms, to form part of a production tubing string having a production tubing flow passage extending therethrough. In one or more embodiments, the screen (420) may include one or more screened or slotted sleeves concentrically positioned around a tubular body, where a filtered flowpath (421) is formed through the screened or slotted sleeves and fluidly connected to the housing flowpath (404) via the inlet (406) of the housing (402). With such configuration, fluid may be filtered (e.g., to remove sand or other large particles) through the screen (420) prior to entering the housing (402). For example, the screen (420) may be a sand screen or sand filter. The flowpath (404) through the housing (402) may be positioned axially between the screen (420) and the valve (410).

As discussed previously, well fluid may enter the housing inlet (406) and flow along the flowpath (404) through the housing (402) of tracer encapsulation system (400), where the fluid encounters the tracer beads (418), and then flows into the production tubing (401) via the outlet (408). In embodiments using a screen (420), the fluid flows along a filtered flowpath (421) through the screen (420) before entering the flowpath (404) through the housing (402) and contacting the tracer beads (418).

Figure 5:
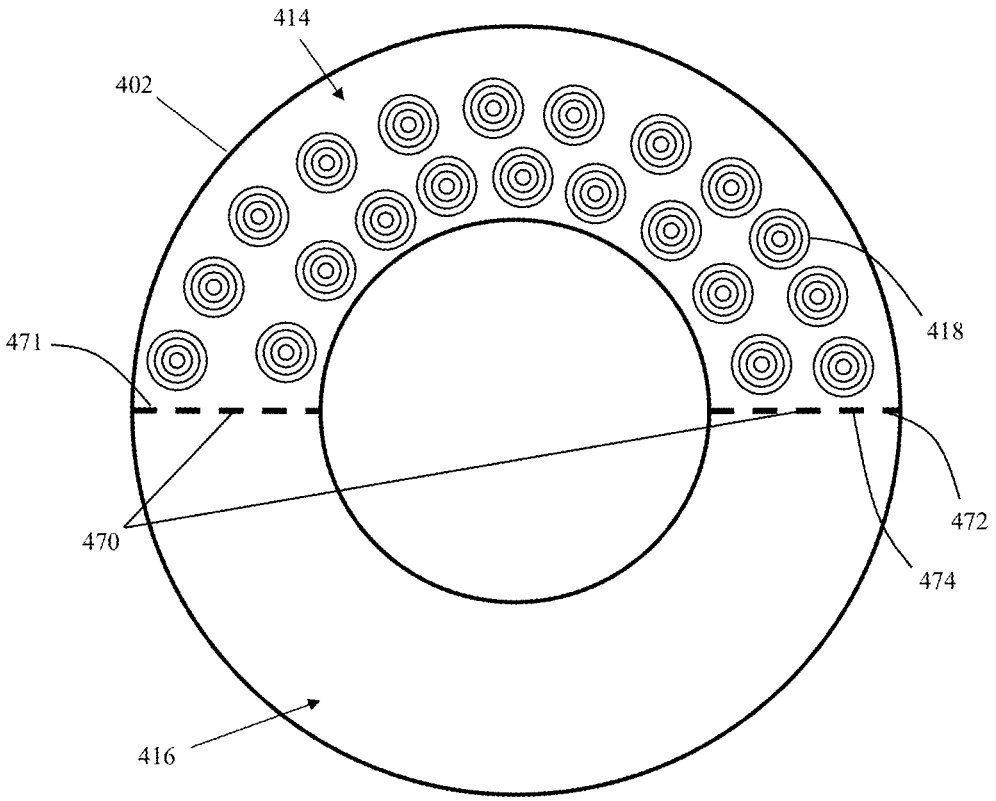
FIG. 5 shows a cross-sectional view of a tracer encapsulation system of FIG. 4 in accordance with one or more embodiments.

FIG. 5 shows a cross-sectional view of the tracer encapsulation system (400) shown in FIG. 4, taken along a plane extending through the housing (402), perpendicular to the longitudinal axis of the assembly. As described previously, the housing (402) includes a permeable barrier (470) dividing the flowpath (404) into a first section (414) and a second section (416). The permeable barrier (470) may include two portions (471, 472) extending axially through the housing (402) to azimuthally divide the first section (414) and the second section (416). Tracer beads (418) are placed inside the first section (414) of the housing (402) along the flowpath (404). The two portions (471, 472) of the permeable barrier (471) hold the tracer beads (418) inside the first section (414). Pores (474) of the permeable barrier are smaller in size compared to the tracer beads (418), so that the tracer beads (418) do not pass through the permeable barrier (470). The permeable barrier (470) is a physical barrier.

As shown in FIGS. 4-5, the housing (402) is not completely filled with the tracer beads (418). In the embodiment shown, the housing (402) is partially filled with tracer beads (418), where a cluster of tracer beads (418) is entirely housed in the first section (414) of the flowpath (404) in the housing (402), and no tracer beads are in the second section (416). The permeable barrier (470) allows fluid (e.g., well fluid) to easily pass through it, while keeping the tracer beads (418) in the first section (414).

When installed downhole, the tracer encapsulation system (400) may be oriented such that the first section (414) is in a gravitationally upper position relative to the second section (416). Thus, in such orientation, the permeable barrier (470) may hold the tracer beads (418) in the gravitationally upper position. By orienting the tracer encapsulation system (400) to hold the tracer beads (418) in a gravitationally upper position when installed in a well, the tracer beads (418) may be held above and separate from water that may accumulate in the gravitationally lower position. For example, during well operations in which fluid is not being actively flowed through the well (e.g., during well shut-in periods), water in a heterogenous well fluid may separate from lower density, immiscible material (e.g., hydrocarbons and/or gases) in the well fluid and settle to a standing water location at a gravitationally lower position in the fluid flowpath. As described more below, tracer beads according to embodiments of the present disclosure may have a layered configuration designed to dissolve in different selected water cut ranges to release tracer compounds associated with the selected water cuts. Holding tracer beads in standing water for prolonged periods (e.g., during a well shut-in) may prematurely dissolve the tracer beads and release the tracer compounds, which may in turn adversely affect water cut measurements of produced well fluid (e.g., when tracer beads are held in standing well fluid with water for a duration long enough to dissolve at lower water cut ranges than selected). By holding the tracer beads (418) separate from a standing water location, premature dissolution of the tracer beads (418) and release of tracer compounds from therein may be prevented.

Figure 6:
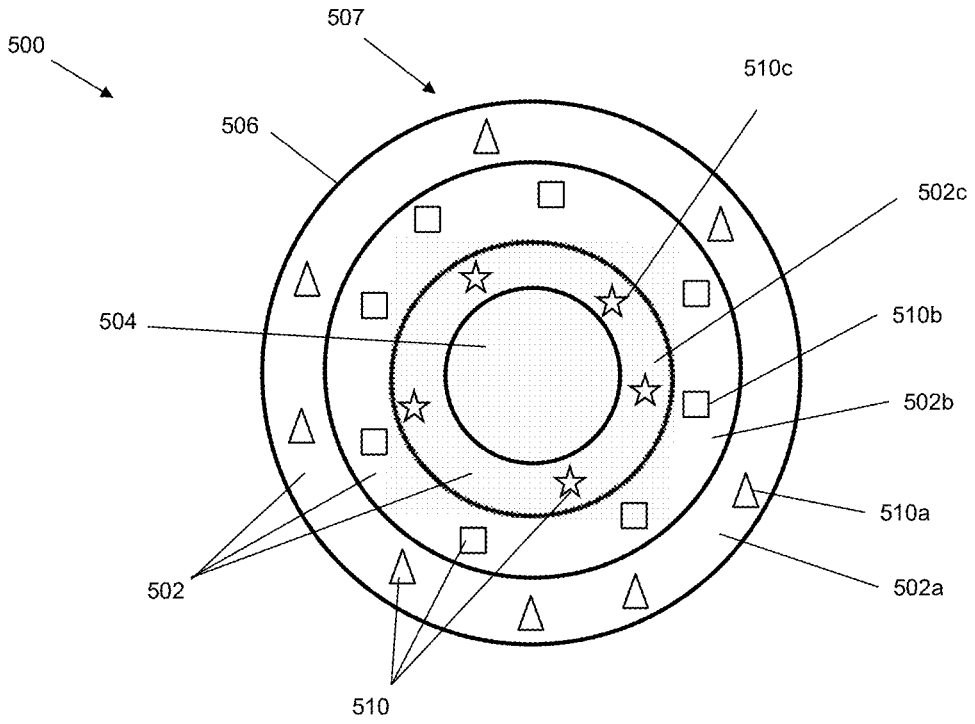
FIG. 6 shows a tracer bead in accordance with one or more embodiments.

FIG. 6 shows an example of a tracer bead useful in conjunction with FIGS. 2-5 in accordance with one or more embodiments. The tracer bead (500) shown in FIG. 6 may be used as the tracer beads (218, 418) described in previous embodiments and figures. The tracer bead (500) may be filled with tracer compounds associated with different water cut ranges, which may be provided with tracer encapsulation systems according to embodiments disclosed herein to measure varying water cuts for each production zone in a well. Specifically, the tracer bead (500) includes multiple dissolvable layers (502*a-c*), collectively referenced as (502), concentrically surrounding an inert core (504). Each layer may entirely surround its substrate (e.g., a base layer or the core) such that the layer forms a shell. A person of ordinary skill in the art may appreciate that the tracer beads (500) may be spherical in shape, such as a ball, or any shape capable of having dissolvable layers. The tracer bead (500) need not be of spherical shape. The inert core (504) may be a solid core made of an inert material, such as metal or plastic. Specifically, FIG. 5 shows a tracer bead (500) having four dissolvable layers, but the tracer bead (500) is not limited to four layers.

Each dissolvable layer (502) includes a layer material having a different solubility in water. In particular, each layer material is designed to dissolve in a fluid (e . . . g, an oil/water mixture) at different ranges of water cut. For example, one of the layers may dissolve in a water cut range of 10-20%, while another layer may dissolve in a water cut range of 20-30%. One of the layers may dissolve in a water cut range of greater than 30% to 100%. Each dissolvable layer (502) is relatively positioned, such that the solubility of each dissolvable layer (502) decreases in a direction toward the inert core (504). As solubility of layer material decreases, the ability of the layer material to dissolve in water also lowers, thereby increasing the amount of water (water cut) in a surrounding fluid needed to dissolve the dissolvable layer. For example, a third dissolvable layer (502*c*) closest to the inert core (504) may be the layer that dissolves in the highest water cut range (e.g., a water cut range of greater than 30% to 100%). A second dissolvable layer (502*b*) surrounding the third dissolvable layer (502*c*) may dissolve in a water cut range of 20-30%. A first dissolvable layer (502*a*) surrounding the second dissolvable layer (502*b*) may dissolve in a water cut range of 10-20%. Although specified ranges of water cut dissolvability or solubility for the dissolvable layers (502) is described herein, a person of ordinary skill in the art would appreciate that there are many different ranges of water solubility that may be used for the dissolvable layers (502).

The layer material of each dissolvable layer (502) includes a tracer compound (510*a-c*), collectively referenced as (510)) disposed in a matrix material. The matrix material may provide the solubility of each dissolvable layer (502), such that when the matrix material of a dissolvable layer dissolves, the tracer compounds (510) within the matrix material are released. The matrix material of the dissolvable layers (502) may be made up of an inorganic nanomaterial and exhibit low reactivity. For example, a dissolvable layer matrix material may be formed of metal oxides, such as silica (SiO2), titanium oxide (TiO), and iron oxide (Fe2O3), and other organic polymers that exhibit variable water solubility.

Tracer compounds may be a compound or agent (e.g., a complexing agent) that may be released from dissolved matrix material of a dissolvable layer and detected at the surface of well. The presence or absence of a tracer compound detected at the surface of the well can provide information about which matrix materials have dissolved, thereby indicating the water cut range present around the location in which the source tracer bead(s) were installed in the well. The tracer compound(s) (510) of each dissolvable layer (502) may be different. Alternatively, some of the dissolvable layers (502) may have identical tracer compounds. Tracer compounds may have physical, chemical, or biological properties to help identify the fluid properties. The abundance of unique tracer compounds may distinguish between different completion/production zones in addition to distinguishing between each dissolvable layer (502) of the tracer bead (500).

Non-limiting examples of tracer compounds may include polymer compounds, dyes, carbon-based fluorescent nanoparticles, fluorinated benzoic acids, rare-earth salts, halogenated organics, alcohols, and fluorescent nanoparticles. For example rare-earth salts, such as ytterbium, dysprosium, and lanthanum may be included. Halogenated organics may include perfluoro methylcyclohexane. Alcohols may include 2-butanol. In one or more embodiments disclosed herein, tracer compounds may include different functional groups, e.g., amines, where the functional groups may distinguish different tracer compounds. Further, in one or more embodiments, one or more different types of functional groups may be provided on a tracer compound to create a barcode unique to the tracer compound.

In the example shown in FIG. 6, unique tracer compounds (510) are dispersed within the layer material of each dissolvable layer (502). The dissolvable layers (502) of the tracer bead (500) may dissolve as fluid contacts the tracer bead (500) (e.g., as the fluid passes through a tracer encapsulation system (160, 200, 300, 400) containing the tracer bead (500) to contact the tracer bead (500)). Each dissolvable layer (502) has a matrix material that dissolves in the presence of fluid having a different water cut range. As outer dissolvable layers (502) dissolve, the tracer compounds are slowly released. For example, a first matrix material of a first dissolvable layer in a tracer bead may be designed to dissolve in a fluid with a first water cut range and release a first tracer compound. Thus, detection of the first tracer compound at the surface of the well indicates that fluid having the first water cut range contacted the first dissolvable layer for sufficient time to dissolve the first matrix material. Accordingly, the downhole location of the tracer bead may also be used to identify the downhole location from which the fluid with the first water cut range is being produced (e.g., a first production zone). In the same manner, detection of different tracer compounds may indicate dissolution of different dissolvable layers, thereby indicating production of fluids with different water cut ranges.

Further, in addition to different tracer compounds being used in different dissolvable layers, different tracer compounds may also be used in tracer beads at different downhole locations in a well. For example, a first type of tracer beads held in a first tracer encapsulation system located at a first downhole location (e.g., in a first production zone) may have a different set of tracer compounds than a second type of tracer beads held in a second tracer encapsulation system located at a second downhole location (e.g., in a second production zone). By providing different tracer compounds in tracer beads at different downhole locations, detected tracer compounds may identify both an associated water cut range (according to the dissolvable layer matrix material from which the tracer compound is released) and an associated downhole location (according to the downhole location at which the tracer bead was installed).

Accordingly, using such tracer beads, tracer encapsulation systems disclosed herein may determine which production zone is producing water and may determine the water cut ranges from that production zone.

In some embodiments, the tracer bead (500) includes an oil soluble coating layer (506) encapsulating the dissolvable layers (502). The oil soluble coating layer (506) forms the outermost surface (507) of the tracer bead (500) in an initial configuration. Additional oil soluble layers may be incorporated in the tracer bead (500) if necessary. The oil soluble coating layer (506) may provide protection of the water-soluble dissolvable layers (502) from fluids, such as drilling muds that may cause premature release of tracer compounds. The oil soluble coating layer (506) may be designed to dissolve in oil at a certain time. For example, the oil soluble coating layer (506) may dissolve relatively quickly in approximately 7 days. During well flow back, initial oil production may dissolve the outermost oil soluble coating layer (506) and expose the tracer-containing dissolvable layers (502) to the reservoir fluids. Well flow back refers to when fluids are produced from a well and flowed back to the surface after a treatment or procedure.

Figure 7:
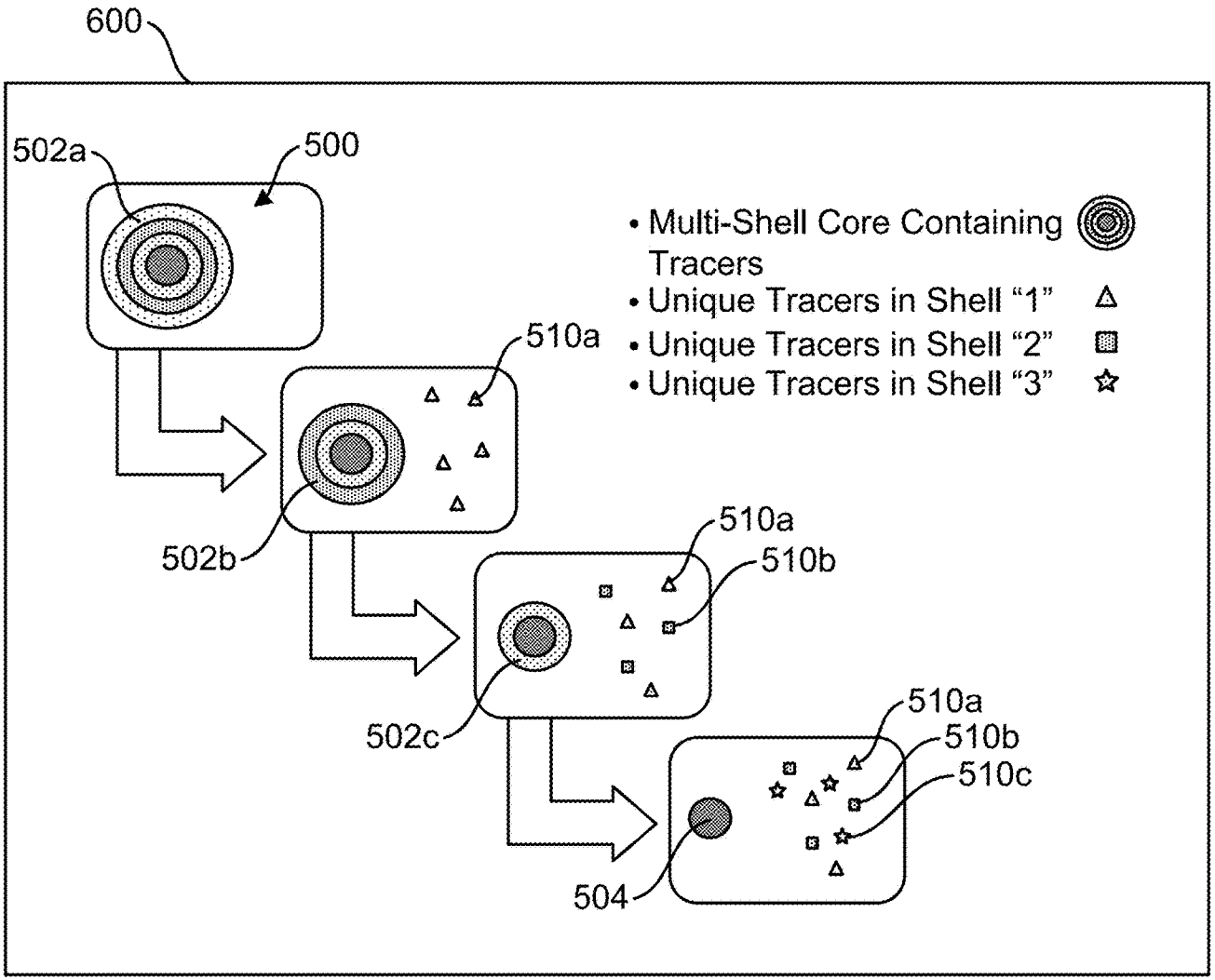
FIG. 7 shows a diagram in accordance with one or more embodiments.

FIG. 7 shows a diagram (600) in accordance with one or more embodiments. Specifically, FIG. 7 shows a diagram depicting a gradual tracer compound release process as the dissolvable layers (502) described in FIG. 6 dissolve. As explained previously, the tracer encapsulation system described herein may be used to determine water cut percentage and which production zone is producing water using different tracer compounds. Tracer compounds in one dissolvable layer may be distinct from tracer compounds in another dissolvable layer. The abundance of unique tracer compounds allow for distinguishing between different completion or production zones in addition to distinguishing between each dissolvable layer of the tracer beads. Therefore, a water cut range from a production zone may be determined.

In FIG. 7, tracer compounds are released as water cut increases. Associated water cut ranges of each tracer compound and dissolvable layer may be modified by adjusting the composition of the dissolvable layer matrix materials. The tracer beads may be designed to slowly dissolve over time. The slow controlled release of the tracer compounds allow time for detection and avoid any premature dissolution. The dissolution rate may be based on lab testing of different layer material types and thicknesses. Although FIG. 7 shows an example of a tracer release process of a single tracer bead, a plethora of tracer beads may be injected in the same production zone and in other zones to provide a slow release of tracer compounds based on surrounding fluid composition of each tracer bead.

In the example process shown in FIG. 7, an outermost oil soluble coating layer (506) of the tracer bead (500) may initially dissolve in an oil-based fluid, leaving a first dissolvable layer (502*a*) exposed as the outer surface of the tracer bead (500). At 0% water cut, the tracer bead (500) may contain all tracer compounds. When the percentage of water cut increases in fluid flowing around and contacting the tracer bead (500), the first dissolvable layer (502*a*) at the outer surface of the tracer bead (500) may dissolve to release first tracer compounds (510*a*) from therein. For example, in one or more embodiments, the matrix material of the first dissolvable layer (502*a*) may be designed (e.g., with a selected material type and thickness) to dissolve in fluid with a water cut ranging from 10 to 15%. When the first dissolvable layer (502*a*) completely dissolves, the second dissolvable layer (502*b*) of the tracer bead (500) forms the new outer surface of the tracer bead.

When the water cut increases, the second dissolvable layer (502*b*) may dissolve to release second tracer compounds (510*b*), different than the first tracer compounds (510*a*). For example, in one or more embodiments, the matrix material of the second dissolvable layer (502*b*) may be designed (e.g., with a selected material type and thickness) to dissolve in fluid with a water cut ranging from 20-40%. Accordingly, in fluid conditions with a water cut ranging from 20-40%, both first and second tracer compounds (510*a*, 510*b*) may be released into and flowing with the surrounding fluid. When the second dissolvable layer (502*b*) completely dissolves, the third dissolvable layer (502*c*) of the tracer bead (500) forms the new outer surface of the tracer bead.

When the water cut increases, the third dissolvable layer (502*c*) may dissolve to release third tracer compounds (510*c*) from therein, the third tracer compounds being different from the first and second tracer compounds (510*a*, 510*b*). For example, in one or more embodiments, the matrix material of the third dissolvable layer (502*c*) may be designed (e.g., with a selected material type and thickness) to dissolve in fluid with a water cut ranging from 50% to 60%. Accordingly, in fluid conditions with a water cut ranging from 50% to 60%, the first, second, and third tracer compounds (510*a*, 510*b*, 510*c*) may be released into and flowing with the surrounding fluid. When the third dissolvable layer (502*c*) completely dissolves, the inert core (504) of the tracer bead (500) forms the new outer surface of the tracer bead.

Tracer compounds may flow with fluid through the well to the well's surface, where the tracer compounds may be detected using different methods, such as spectrometry and water samples. In one or more embodiments, spectrometry may be used to detect the amount of tracer compounds and type of tracer compounds. For example, tracer compounds may be detected using fluorescence, ultraviolet-visible (UV-Vis) spectroscopy, Fourier-transform infrared spectroscopy (FTIR), Raman spectroscopy, mass spectroscopy (MS), high performance liquid chromatography (HPLC), or liquid chromatography-mass spectroscopy (LC-MS), or any combination thereof. Water samples may be taken regularly or as soon as water cut percentage increases. More than one sample may be taken at different points of time for results verification. Further, while various methods are described herein as detecting tracer compounds at the surface of the well, in some embodiments, tracer compounds may be detected within the well. For example, an in-situ spectrometer may be installed in the well to detect the tracer compounds as fluid flows through the well. In some embodiments, a spectrometer may be placed in a multiphase flow meter located at the surface and/or located downhole.

Figure 8:
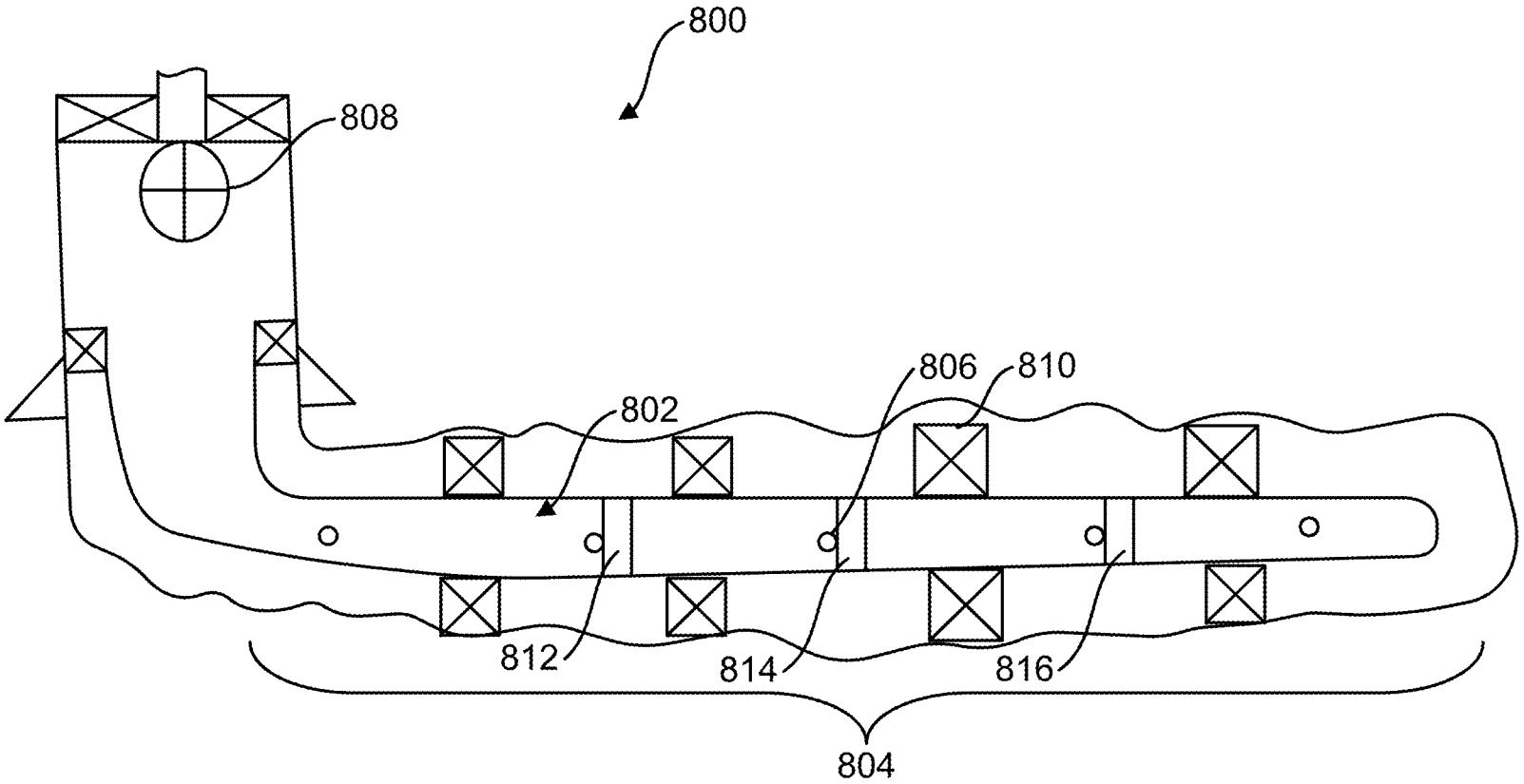
FIG. 8 shows a lateral well in accordance with one or more embodiments.

FIG. 8 shows a lateral well (800) in accordance with one or more embodiments. The tracer encapsulation system described in the previous embodiments may be implemented in a downhole oil well environment, such as the lateral well (800) of FIG. 8. The tracer encapsulation system described herein may be used to detect breakthrough of water and to approximately quantify water cut when ingress continues through life of the lateral well (800). Water contributing production zones may be identified using the tracer encapsulation system. For example, a housing (e.g., housing (202, 402)) of the tracer encapsulation system is provided along production tubing (802) and located in a lateral section (804) of the lateral well (800). The housing may be provided annularly along the production tubing (802) and/or part of an inflow control device (806). In such configurations, tracer beads (e.g., tracer beads (218, 418, 500)) may be held in a housing placed in or around flow control equipment, including inflow control devices and valves present within a well completion. Specifically, FIG. 8 illustrates conventional locations of inflow control devices (806), inflow control valves (808), and packers (810) of a lateral well (800). As stated previously, the tracer encapsulation system presented herein may be placed or installed at any point in the fluid flow path in the well.

According to embodiments disclosed herein, tracer encapsulation systems may be positioned in different isolated segments of the well (e.g., isolated between packers (810)), where tracer encapsulation systems in each isolated well segment may hold tracer beads having unique tracer compounds. For example, a first tracer encapsulation system (812) (e.g., as described with FIGS. 2-5) may be positioned proximate to or provided integrally with an inflow control device 806 isolated in a first well segment between a pair of packers (810), where the first tracer encapsulation system (812) may hold tracer beads containing one or more tracer compounds. A second tracer encapsulation system (814) (e.g., as described with FIGS. 2-5) may be positioned proximate to or provided integrally with an inflow control device 806 isolated in a second well segment between a pair of packers (810), where the second tracer encapsulation system (814) may hold tracer beads containing one or more tracer compounds different from those in the first tracer encapsulation system (812). A third tracer encapsulation system (816) (e.g., as described with FIGS. 2-5) may be positioned proximate to or provided integrally with an inflow control device 806 isolated in a third well segment between a pair of packers (810), where the third tracer encapsulation system (816) may hold tracer beads containing one or more tracer compounds different from those in the first and second tracer encapsulation systems (812, 814). More or less than three tracer encapsulation systems having tracer beads containing different tracer compounds may be isolated in different well segments in a similar manner.

As fluid is produced from each isolated well segment, the produced fluid may selectively dissolve dissolvable layers of the tracer beads in the associated tracer encapsulation system depending on the water cut in the produced fluid and the water cut range the dissolvable layers are designed to dissolve in, e.g., as described with the process described above with FIGS. 5-6. In such manner, detected tracer compounds may be identified and associated with a water cut range in fluid produced from individual isolated well segments.

Figure 9:
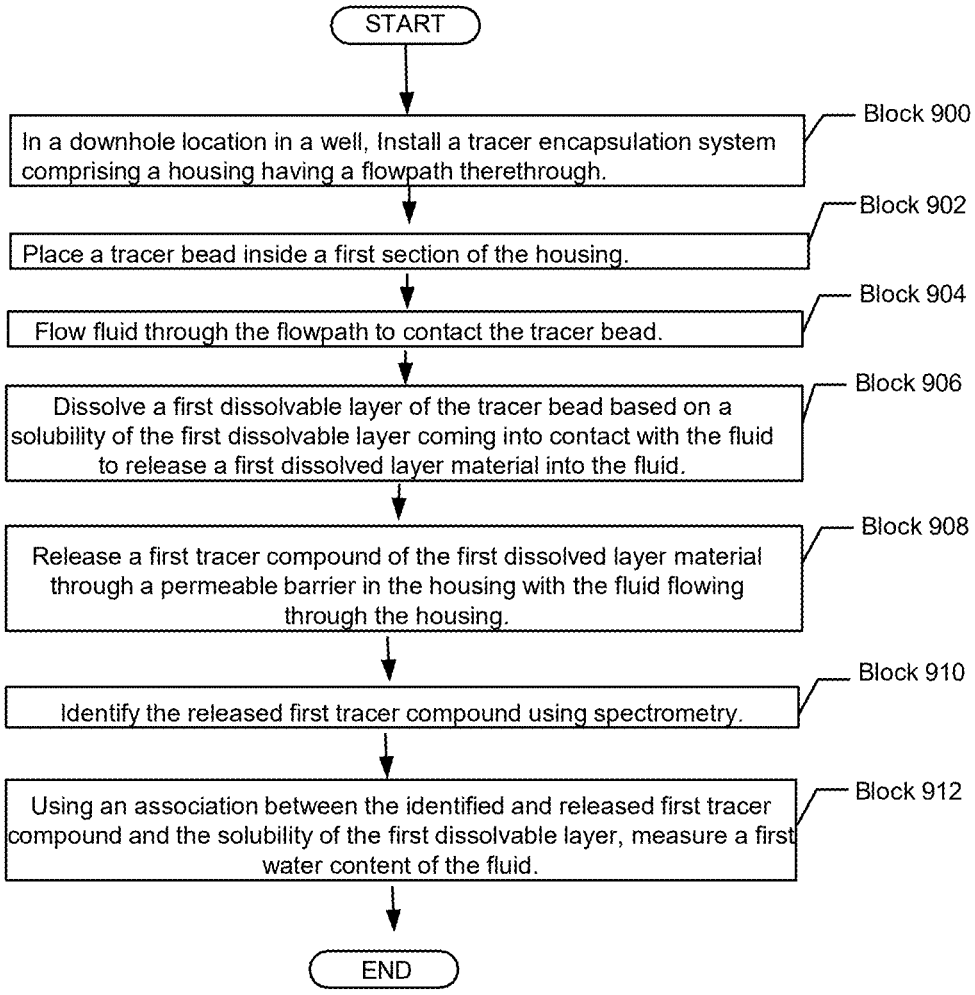
FIG. 9 shows a flowchart in accordance with one or more embodiments.

FIG. 9 shows a flowchart in accordance with one or more embodiments. Specifically, FIG. 9 describes a general method for a tracer encapsulation system (e.g., tracer encapsulation system (200)) for a production tubing in a well. One or more blocks in FIG. 9 may be performed by one or more components (e.g., tracer bead (218, 418, 500)) as described in FIGS. 1-8. While various blocks in FIG. 9 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 900, a tracer encapsulation system comprising a housing having a flowpath therethrough is installed in a downhole location in the well. The flowpath is divided into a first section and second section by a permeable barrier. The tracer encapsulation system may be self-oriented based on a direction of gravity using a counterweight disposed in the second section. In Block 902, a tracer bead is placed inside the first section of the housing. The tracer bead includes multiple dissolvable layers concentrically surrounding an inert core. Each dissolvable layer includes a layer material having a different solubility. The tracer bead has a larger diameter than pores of the permeable barrier, so that the tracer bead does not pass through the permeable barrier. In one or more embodiments, each of the dissolvable layers of the tracer bead may also have a diameter larger than the pores of the permeable barrier, such that the tracer bead does not pass through the permeable barrier as it dissolves.

In Block 904, fluid flows through the flowpath to contact the tracer bead. The flowpath in the housing may be fluidly connected to a production tubing flow passage, e.g., via a valve. A screen may be connected to the housing, such that a filtered flowpath through the screen is fluidly connected to the flowpath through the housing. The fluid may flow through the filtered flowpath prior to flowing through the housing. In Block 906, a first dissolvable layer of the tracer bead is dissolved based on a solubility of the first dissolvable layer when the first dissolvable layer comes into contact with the fluid to release a first dissolved layer material into the fluid. The first dissolved layer material includes a first tracer compound. The first tracer compound is associated with the solubility of the first dissolvable layer. In one or more embodiments, prior to dissolving the first dissolvable layer, an oil soluble coating encapsulating the dissolvable layers and forming an outermost surface of the tracer bead in an initial configuration may be dissolved by contacting the tracer bead with an oil in the fluid.

In Block 908, a first tracer compound of the first dissolved layer material is released through the permeable barrier in the housing with the fluid flowing through the housing. The first dissolved layer material may include first tracer compounds having a size smaller than the pores in the permeable barrier, such that the first tracer compounds may be released into the flow of fluid through the production tubing flow passage. In Block 910, the released first tracer compound is identified using spectrometry. In Block 912, using an association between the identified and released first tracer compound and the solubility of the first dissolvable layer, a first water content of the fluid is measured. The first water content of the fluid may be associated with a production zone in the well based on the downhole location of the tracer encapsulation system.

In some embodiments, a second dissolvable layer of the dissolvable layers is dissolved based on the solubility of the second dissolvable layer when the second dissolvable layer comes into contact with the fluid having a second water cut range to release a second dissolved layer material into the fluid. The second dissolved layer material may include a second tracer compound having a size smaller than the pores in the permeable barrier, such that the second tracer compound may be released into the flow of fluid through the production tubing flow passage. The second tracer compound may be associated with the solubility of the second dissolvable layer. The solubility of the second dissolvable layer may be lower than the solubility of the first dissolvable layer. The second tracer compound released may be identified using spectrometry. The association between the identified and released second tracer compound and the solubility of the second dissolvable layer may be used to measure a second water content of the fluid. The second water content may be greater than the first water content.

The method steps described with FIG. 9 and throughout this disclosure may be repeated for multiple dissolvable layers and in multiple different production zones.

Embodiments herein provide the following potential benefits. The tracer encapsulation system provides a multi-shell water sensor system capable of approximating water cuts and identifying the production zone where water breakthrough occurs. Intervention operational costs may be reduced. For example, water contribution may be identified for each completion zone in a lateral well based on tracer compound type. The tracer encapsulation system may serve as a production logging tool. If the tracer beads are injected into a reservoir, the tracer beads may potentially detect crossflow based on water movement. Rate tests conducted at surface may be validated. Further, the tracer beads may be made of inexpensive eco-friendly material.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. Further, although multiple dependent claims are not introduced, it would be apparent to one of ordinary skill that the subject matter of the dependent claims of one or more embodiments may be combined with other dependent claims.

What is claimed is:

1. A tracer encapsulation system comprising:

a housing comprising:

a flowpath fluidly connecting an inlet of the housing to an outlet of the housing; and a permeable barrier extending across the flowpath, wherein the permeable barrier divides the flowpath into a first section and a second section;

a tracer bead disposed inside the first section of the housing, the tracer bead comprising multiple dissolvable layers concentrically surrounding an inert core, wherein each dissolvable layer comprises a layer material having a different solubility in water, and wherein the multiple dissolvable layers are relatively positioned such that the solubility of each dissolvable layer decreases in a direction toward the inert core;

wherein the tracer bead has a diameter larger than pores in the permeable barrier, so that the tracer bead does not pass through the permeable barrier.

2. The tracer encapsulation system of claim 1, wherein the first section contains a plurality of the tracer beads.

3. The tracer encapsulation system of claim 1, wherein the layer material of each dissolvable layer comprises a tracer compound disposed in a matrix material, wherein the matrix material provides the solubility of each dissolvable layer, and wherein the tracer compound in each of the dissolvable layers is different.

4. The tracer encapsulation system of claim 1, wherein the tracer bead further comprises an oil soluble coating encapsulating the dissolvable layers such that the oil soluble coating forms an outermost surface of the tracer bead.

5. The tracer encapsulation system of claim 1, wherein the multiple dissolvable layers comprise an inorganic nanomaterial.

6. The tracer encapsulation system of claim 1, wherein the permeable barrier comprises an alloy or a nonmetallic material.

7. The tracer encapsulation system of claim 1, wherein the inert core comprises a metal material or a plastic material.

8. The tracer encapsulation system of claim 1, further comprising:

a counterweight provided along a side of the housing opposite from the first section.

9. The tracer encapsulation system of claim 1, wherein the housing is provided along a production tubing string and located in a lateral section of a well.

10. The tracer encapsulation system of claim 1, wherein the housing extends annularly around a production tubing flow passage, wherein the flowpath has an annular shape, wherein the permeable barrier includes two portions extending axially through the housing to azimuthally divide the first section and the second section, and wherein the outlet is fluidly connected to the production tubing flow passage.

11. The tracer encapsulation system of claim 1, wherein the outlet is fluidly connected to an interior of a production tubing via a valve.

12. The tracer encapsulation system of claim 1, further comprising a screen connected to a first end of the housing, wherein a filtered flowpath through the screen is fluidly connected to the inlet of the housing.

13. The tracer encapsulation system of claim 12, wherein the housing is integrally provided with an inflow control device, the inflow control device further comprising an inflow control device outlet, wherein the flowpath through the housing is positioned axially between and fluidly connects the filtered flowpath and the inflow control device outlet.

* * * * *